US009527563B2

(12) United States Patent
Dane et al.

(10) Patent No.: US 9,527,563 B2
(45) Date of Patent: Dec. 27, 2016

(54) OPENING RIGID WING

(71) Applicant: SOLAR SAILOR PTY LTD, Sydney, New South Wales (AU)

(72) Inventors: Robert Dane, Sydney (AU); Ninan Mathew, Sydney (AU); Ian McBride, Sydney (AU)

(73) Assignee: SOLAR SAILOR PTY LTD, Sydney (AU)

( * ) Notice: Subject to any disclaimer, the term of this patent is extended or adjusted under 35 U.S.C. 154(b) by 0 days.

(21) Appl. No.: 14/432,691

(22) PCT Filed: Oct. 8, 2013

(86) PCT No.: PCT/AU2013/001153
§ 371 (c)(1),
(2) Date: Mar. 31, 2015

(87) PCT Pub. No.: WO2014/053029
PCT Pub. Date: Apr. 10, 2014

(65) Prior Publication Data

US 2015/0266555 A1 Sep. 24, 2015

(30) Foreign Application Priority Data

Oct. 5, 2012 (AU) ..... 2012904360

(51) Int. Cl.
*B63H 9/08* (2006.01)
*B63H 9/06* (2006.01)

(52) U.S. Cl.
CPC ..... *B63H 9/0607* (2013.01); *B63H 9/08* (2013.01); *B63H 2009/0635* (2013.01)

(58) Field of Classification Search
CPC ..... B63B 9/0607; B63B 9/08; B63H 9/08
See application file for complete search history.

(56) References Cited

U.S. PATENT DOCUMENTS 3,934,533 A * 1/1976 Wainwright ..... B63H 9/0607 114/102.16
4,418,632 A 12/1983 Yoshimi
(Continued)

FOREIGN PATENT DOCUMENTS

DE 3836259 4/1990
DE 9004412 U1 9/1990
GB 1410175 A 10/1975

OTHER PUBLICATIONS

International Search Report for PCT/AU2013/001153, Completed by the Australian Patent Office on Nov. 7, 2013, 4 Pages.
(Continued)

*Primary Examiner* — Stephen Avila
(74) *Attorney, Agent, or Firm* — Young Law Firm, P.C.

(57) ABSTRACT

A rigid wing sail fitted to a water-borne vessel. The rigid wing sail includes a pair of elongate rigid panels, and a hinge element designated generally as coupled to the panels to permit pivotal movement of the panels relative to one another. Each of the pair of panels includes an adjoining edge and an opposing lateral edge. The hinge element is coupled to the panels at the respective adjoining edges to form either a closed configuration of the wing with lateral edges of respective panels positioned adjacent one another wherein the rigid wing sail is closed or an open configuration of the wing with the lateral edges of the respective panels separated from one another wherein the rigid wing sail is set at a variable camber.

20 Claims, 13 Drawing Sheets

(56) References Cited

U.S. PATENT DOCUMENTS

| | | | |
|---|---|---|---|
| 4,505,217 | A | 3/1985 | Endo et al. |
| 4,537,146 | A | 8/1985 | Wainwright |
| 6,431,100 | B2 | 8/2002 | Abshier |
| 7,461,609 | B1 | 12/2008 | Ott et al. |
| 2005/0012079 | A1 | 1/2005 | Roberts |
| 2008/0245284 | A1 | 10/2008 | Kruppa |

OTHER PUBLICATIONS

European Patent Office (EPO) Extended Search Report dated Jul. 16, 2016 in EP application 13843476.6.

CIPO Office Action of Aug. 22, 2016 CN application 201380051244.6.

* cited by examiner

OPENING RIGID WING

CROSS-REFERENCE TO RELATED APPLICATION

This application is the U.S. national phase of PCT Application No. PCT/AU2013/001153 filed on Oct. 8, 2013, which claims priority to AU Patent Application No. 2012904360 filed on Oct. 5, 2012, the disclosures of which are incorporated in their entirety by reference herein.

TECHNICAL FIELD

The present invention relates broadly to a rigid wing and relates particularly, although not exclusively, to a rigid wing sail for propelling a vessel.

BACKGROUND OF INVENTION

In designing water-borne vessels to be propelled by wind, custom sails are fabricated for specific sailing craft and configurations. The custom sails are fabricated from a flexible and pliable sail cloth and are typically referred to as soft sails. While designers and sail makers provide efficient designs for specific sailing craft, soft sails deform 'or luff' in strong winds when for example the sails are angled acutely into the wind when sailing upwind.

In addressing shortcomings in efficiency dependent on sail trim with soft sails, rigid wing sails have more recently been adopted, particularly in racing sail boats. The rigid wing sail can be pivoted or slewed to adjust its angle of attack to the wind for the most efficient operation and propulsion of the water-borne vessel to which it is mounted. The rigid wing sail is generally of a symmetrical section which allows it to develop lift on either side according to whether the vessel is on port or starboard tack. However, a rigid wing sail suffers from at least the following drawbacks:

(i) it cannot decrease its area by 'reefing' in strong winds or increase its area by 'unfurling' in light winds;

(ii) a rigid wingsail cannot change its camber;

(iii) even when depowered or 'feathered' and placed parallel to the direction of the wind, a rigid wing sail is difficult to control and depower.

SUMMARY OF INVENTION

According to the present invention there is provided a rigid wing sail comprising:

- a pair of elongate rigid panels each having an adjoining edge opposing a lateral edge;
- a hinge element including a mast coupled to the pair of elongate rigid panels at or near their adjoining edges to permit pivotal movement of said rigid panels relative to one another and about the mast to form:
  - i) a closed configuration wherein the lateral edges of said rigid panels are adjacent one another wherein the rigid wing is substantially closed; or
  - (ii) various open configurations wherein the lateral edges of the elongate rigid panels are separated from one another wherein the rigid wing is set at a variable camber to effectively capture wind by shifting the relative disposition of the rigid panels to reshape and alter the camber of the rigid wing sail;
- wherein the mast is located at the adjoining edges of the pair of rigid panels in the closed and various open configurations.

Preferably each of the pair of panels is one continuous piece of a rigid material.

Preferably the pair of panels are each curved panels of an asymmetric sectional shape. More preferably the pair of panels have substantially the same profile and sectional shape. Even more preferably the rigid wing at the variable camber is symmetric either side of the hinge element.

Preferably the hinge element is in the form of a piano-type hinge.

Alternatively the rigid wing also comprises other hinge elements arranged parallel to and spaced from an axis of the hinge element to further open the rigid wing and when folded the elongate panels fold inward so an exterior shape of the rigid wing makes an aerofoil cross section.

Preferably the rigid wing further comprises hinge actuating means operatively coupled to the hinge element for pivotal movement of said panels relative to one another. More preferably the hinge actuating means includes one or more gears operatively coupled to at least one of the elongate panels and the hinge element.

Preferably the rigid wing further comprises slewing means operatively coupled to the shaft to permit slewing of the shaft about its longitudinal axis to orient the rigid wing at a required angle to the wind.

Preferably the hinge actuating means includes slewing means configured to orient the wing at a required angle to the wind.

Preferably the mast is mounted to a joint mechanism which permits tilting of the mast thereby raising and lowering of the mast and the associated rigid wing. More preferably the rigid wing when lowered together with the mast is designed wherein the rigid panels are:

a) closed and folded one side or another on a deck;

b) closed and stowed into a superstructure and hull of a vessel;

c) opened and 'wrapped' around a superstructure of a vessel which is designed to be of a complementary shape;

d) opened and stored horizontally as an 'awning'.

In an alternative embodiment the rigid wing also comprises solar collection means mounted or applied to at least an exposed surface of the pair of elongate panels.

Preferably the rigid wing is adapted to fit to a vehicle. More preferably the vehicle is a water-borne vessel.

BRIEF DESCRIPTION OF DRAWINGS

In order to achieve a better understanding of the nature of the present invention a preferred embodiment of a rigid wing sail will now be described, by way of example only, with reference to the accompanying drawings in which.

DETAILED DESCRIPTION

As shown in FIGS. 1A to 1I there is a rigid wing 10 which in its preferred embodiment is a rigid wing sail fitted to a water-borne vessel (not shown). The rigid wing sail 10 comprises a pair of elongate panels 12A and 12B, and a hinge element designated generally as 14 coupled to the panels 12A/B to permit pivotal movement of the panels 12A/B relative to one another. Each of the pair of panels such as 12A includes an adjoining edge 16A and an opposing lateral edge 18A. The pair of panels 12A/B in this embodiment form a mirror image about a centreline defined by the hinge element 14 The hinge element 14 is coupled to the panels 12A/B at their respective adjoining edges 16A/B to form either:

1. a closed configuration of the wing 10 with the lateral edges 18A/B of respective panels 12A/B positioned adjacent one another wherein the rigid wing sail 10 is closed; or
2. an open configuration of the wing 10 with the lateral edges 18A/B of the respective panels 12A/B separated from one another wherein the rigid wing sail 10 is set at a variable camber.

Figure 1A:
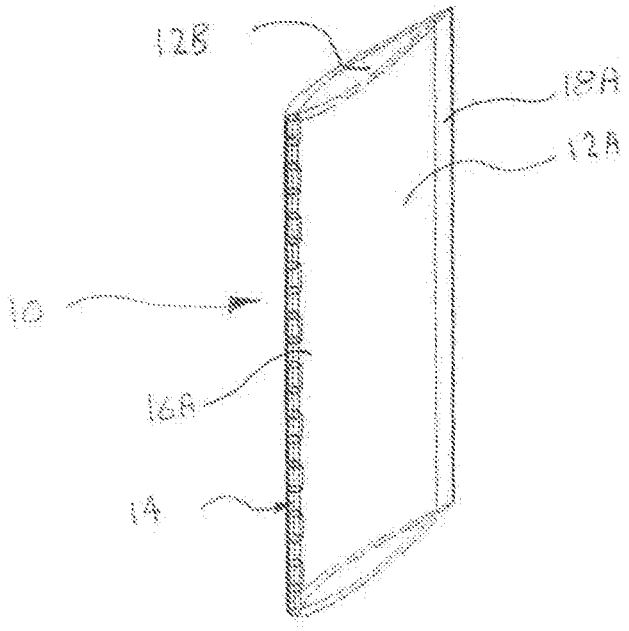
FIGS. 1A to 1I are various views of a rigid wing sail according to an embodiment of the invention shown in different configurations.
Figure 1B:
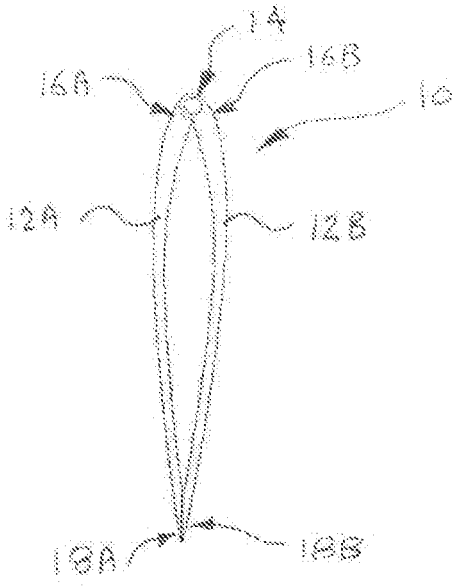
Figure 1C:
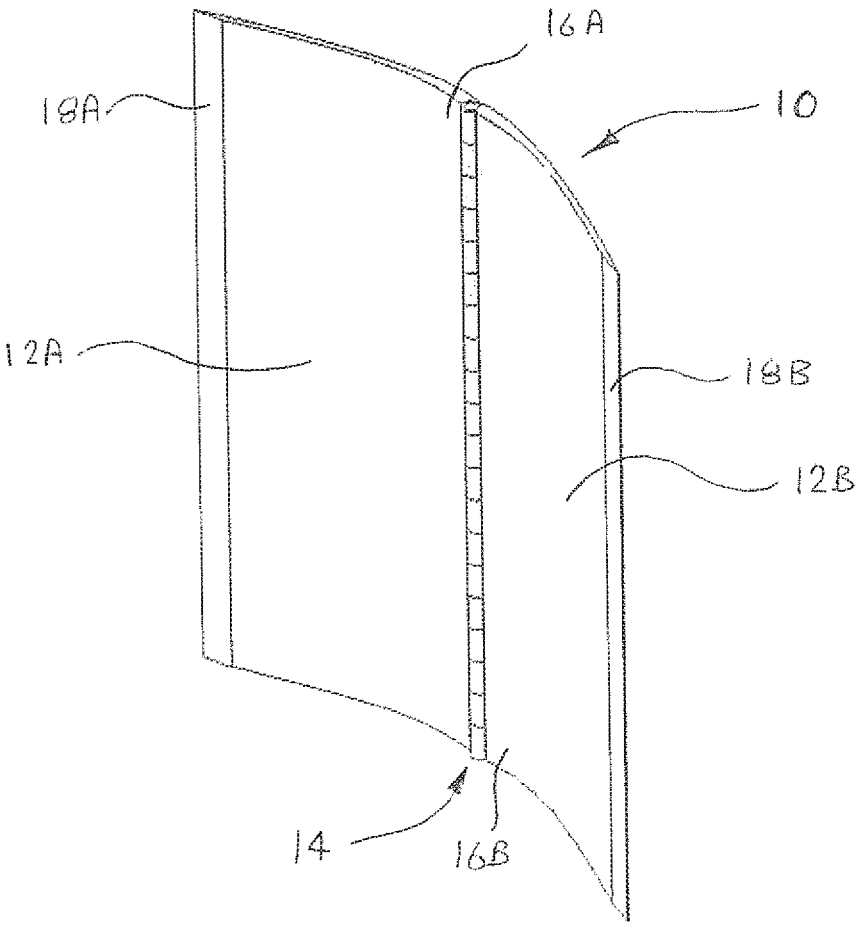
Figure 1D:
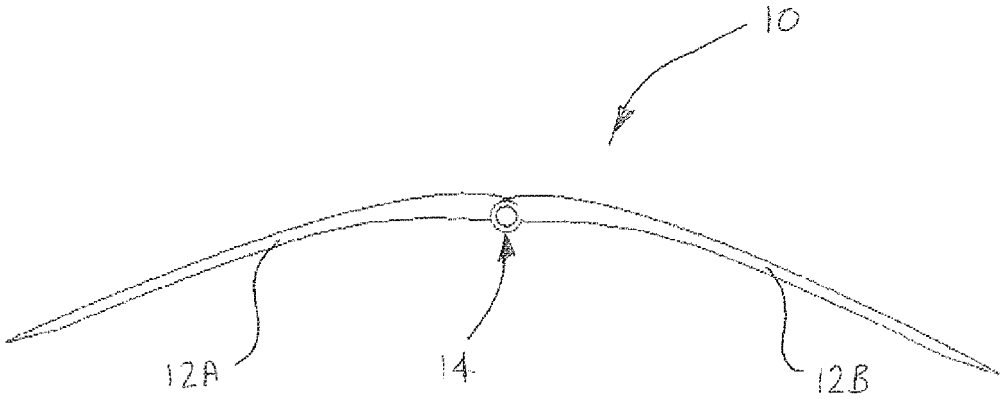
Figure 1E:
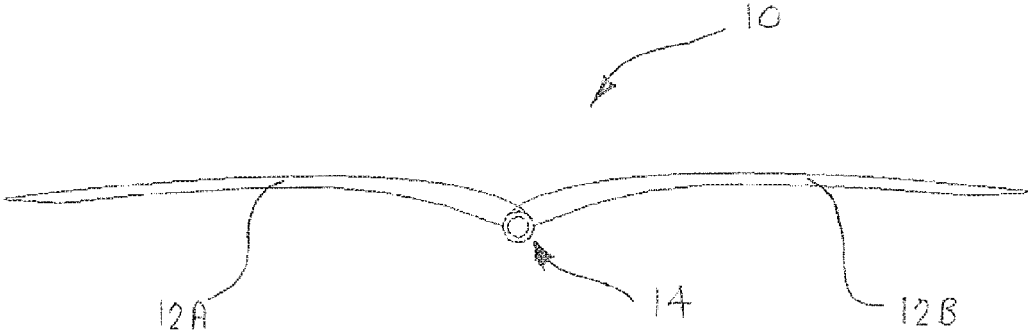
Figure 1F:
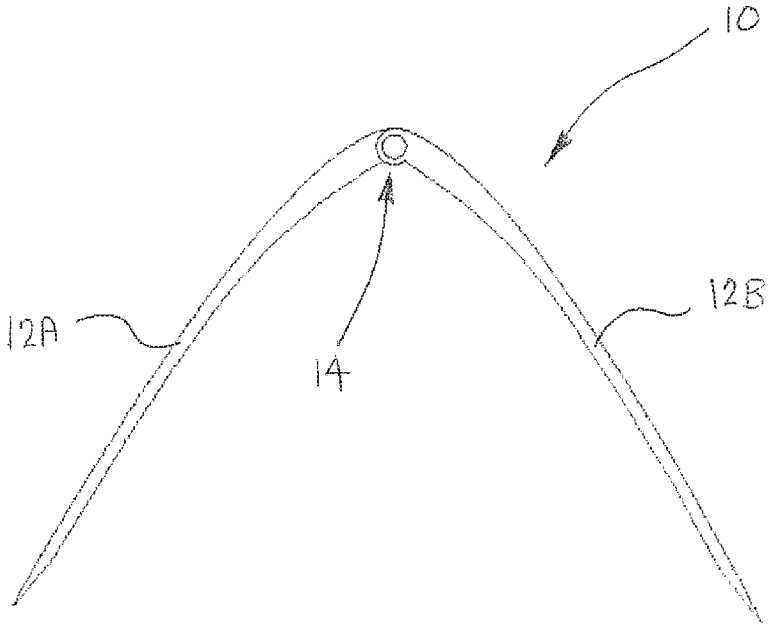
Figure 1G:
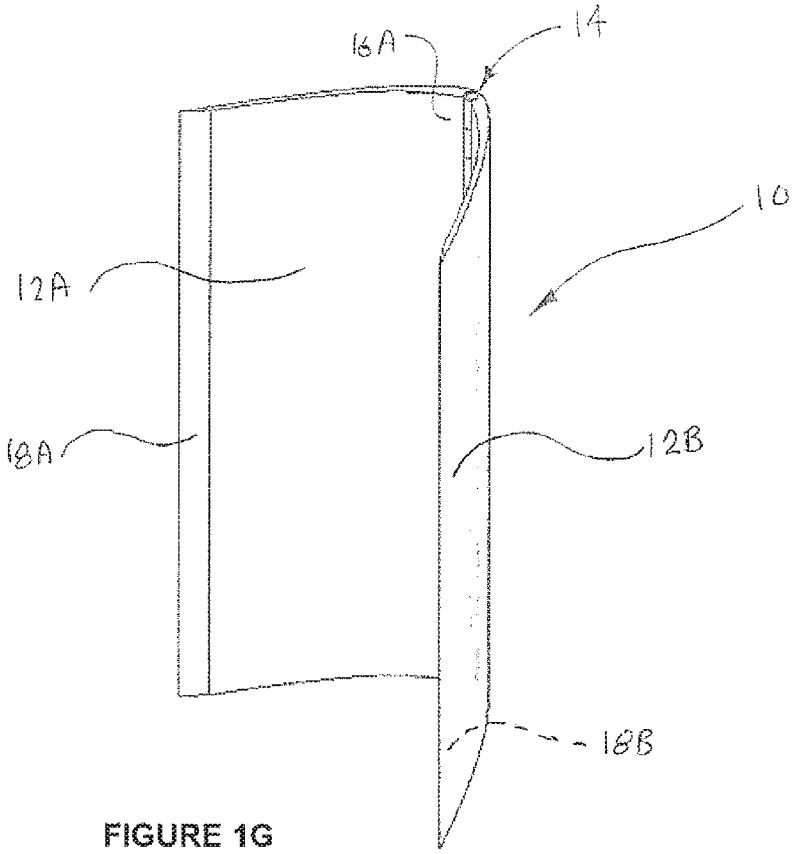
Figure 1H:
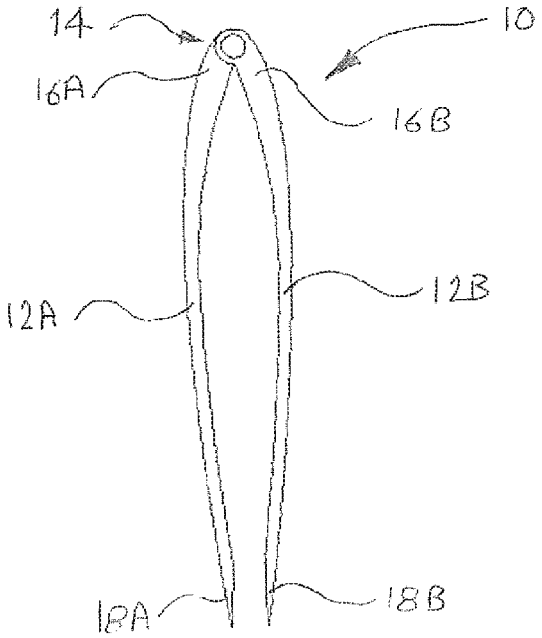
Figure 1I:
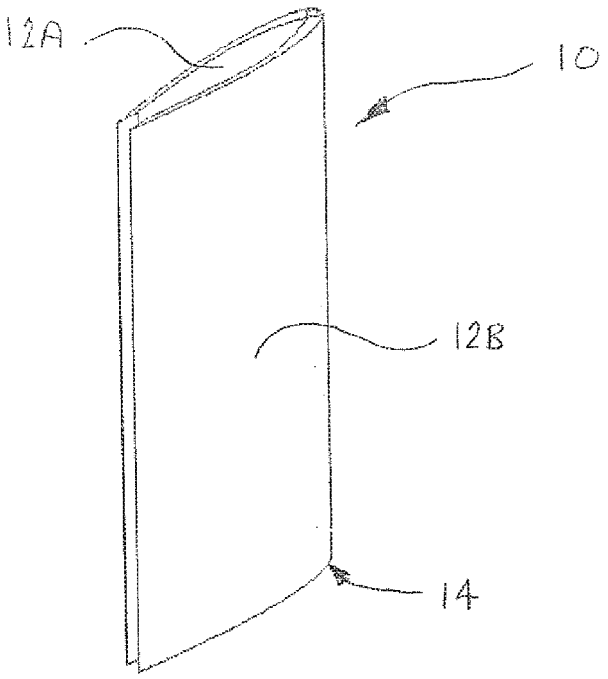

The rigid wing 10 in its closed configuration is for example shown in FIGS. 1A and 1B whereas FIGS. 1C to 1G show the rigid wing 10 in various open configurations at variable cambers. FIGS. 1H and 1I show the rigid wing 10 substantially closed where the thickness of the aerofoil section is changed from that of the rigid wing 10 in its closed configuration in FIGS. 1A and 1B.

In this preferred embodiment each of the elongate panels of 12 A/B is fabricated in one continuous piece. The one-piece panel such as 12A is in cross-section curved and of an asymmetric shape. This asymmetric shape is designed so that the pair of panels 12A/B in the closed configuration form a symmetric wing having an aerofoil shape. Each of the one-piece panels is fabricated from a rigid material such as a metal, for example steel or aluminium.

Figure 2:
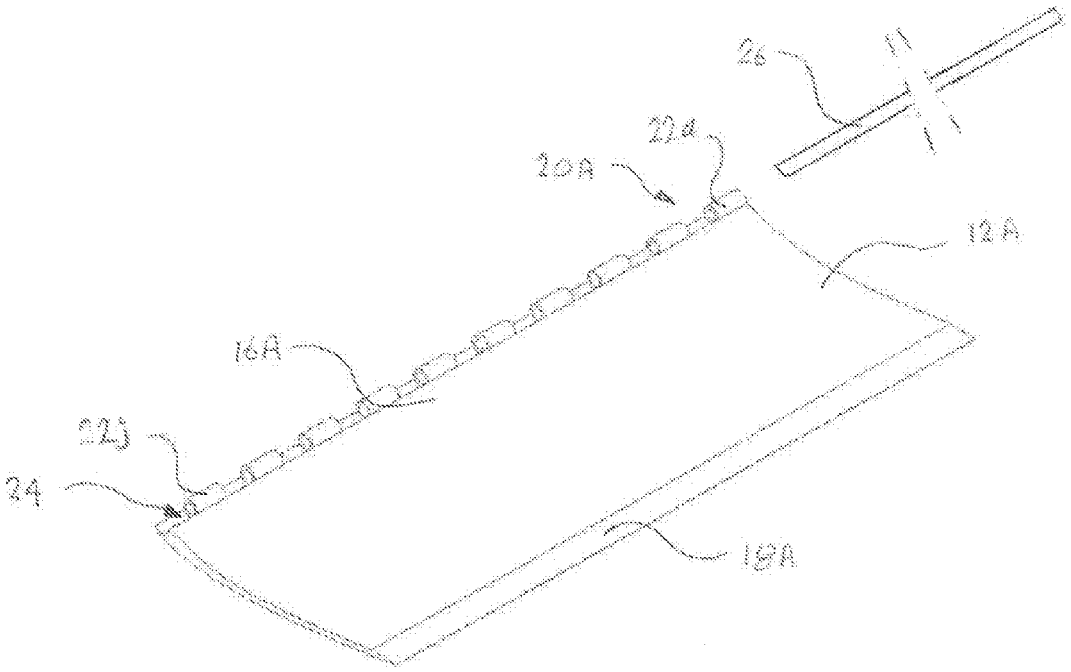
FIG. 2 is a perspective view of one of the pair of elongate panels from the rigid wing of the preferred embodiment.

As shown in FIG. 2 the hinge element 14 is in the form of a piano-type hinge 20A connected to respective adjoining edges 16A of the panels such as 12A. The piano-type hinge 20A includes a plurality of equally spaced tubular segments such as 22*a* to 22*j* aligned coaxially with one another. The tubular segments 22*a* to 22*j* of the elongate panel 12A are designed to mesh with corresponding tubular segments 22*a*' with 22*j*' of the other elongate panel 12B. The meshed tubular segments 22*a* to 22*j* and 22*a*' to 22*j*' define an elongate bore 24. The hinge element 14 of this embodiment includes a shaft 26 which is received within the elongate bore 24. The pair of elongate panels 12A/B are thus permitted to pivot about the shaft 26 relative to one another for movement into or toward the open or closed configurations.

Figure 3A:
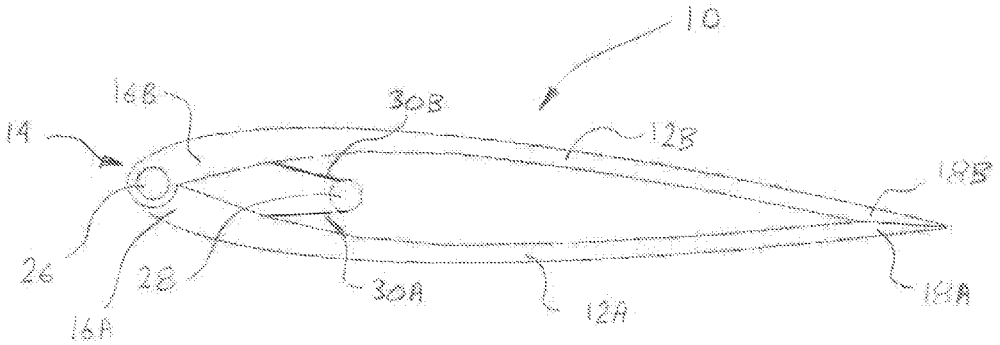
FIGS. 3A and 3B are different views of another embodiment of a rigid wing according to the invention shown in a closed configuration.
Figure 3B:
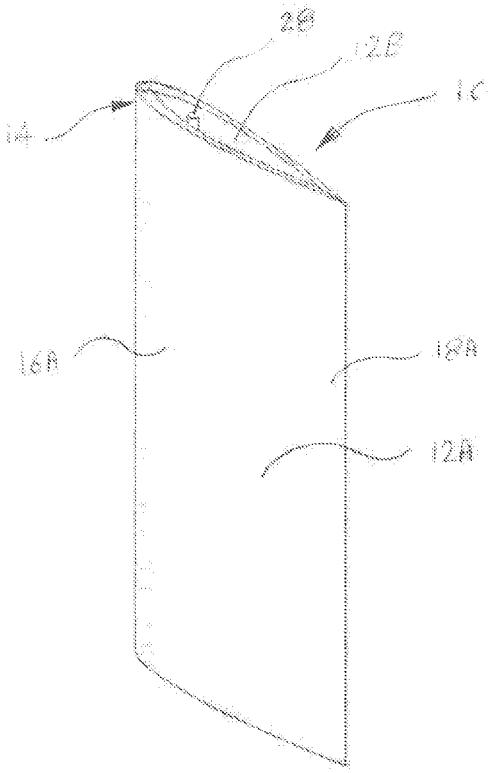

FIGS. 3A and 3B depict another embodiment of a rigid wing sail 10 which is similar to the preceding embodiment but with a mast 28 located within the rigid wing 10 in its closed configuration. For ease of reference and in order to avoid repetition like components of this embodiment have been designated with the same reference numeral as the preceding and preferred embodiment. The rigid wing 10 includes one or more pairs of struts such as 30A and 30B longitudinally spaced along the mast 28. The struts 30A and 30B are of an equal and fixed length and connected to the respective panels 12A and 12B at a position relative to the shaft 26 of the hinge element 14 so that the geometry lends itself to opening and closure of the panels 12A/B relative to one another. The struts 30A/B pivotally connect opposing ends to the mast 28 and the corresponding wing 12A or 12B respectively. With the mast 28 spaced back from the leading edge of the rigid wing sail 10 it is "balanced" when in its closed and open configurations.

Figure 4A:
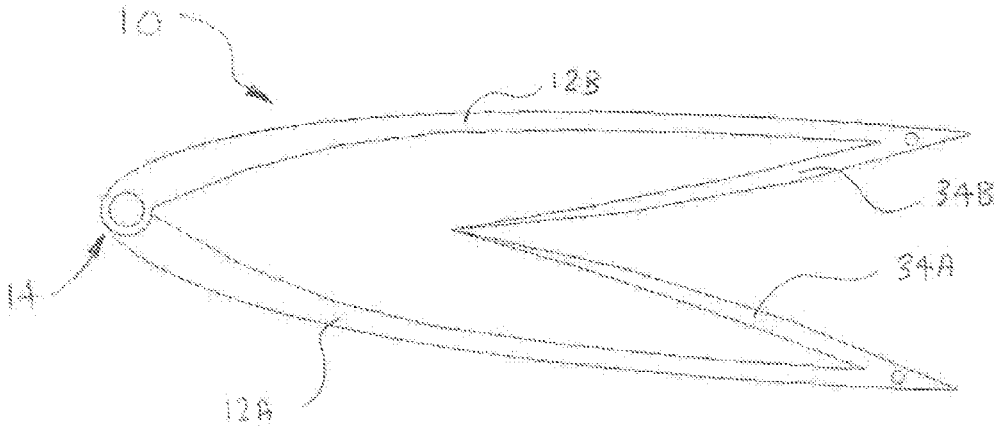
FIGS. 4A to 4C are different views of a rigid wing according to yet another embodiment of the invention shown in various configurations.
Figure 4B:
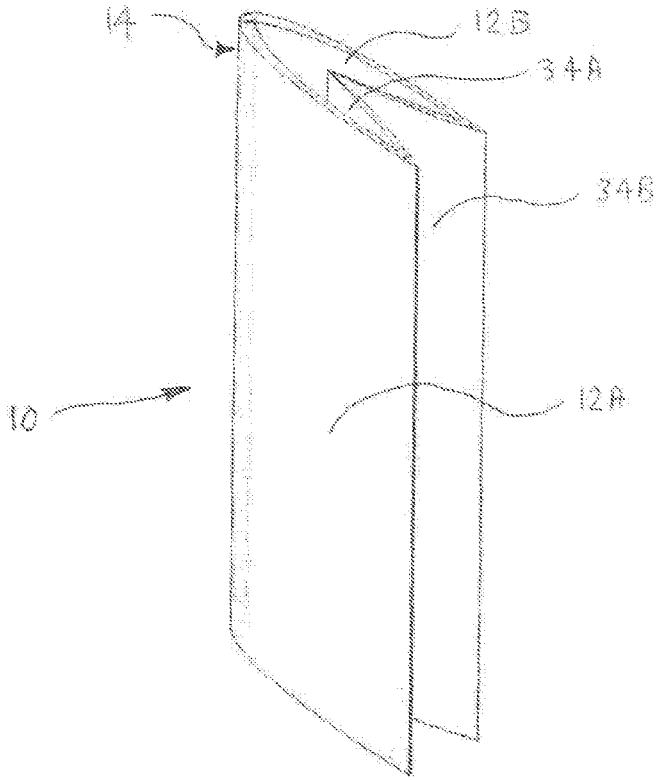
Figure 4C:
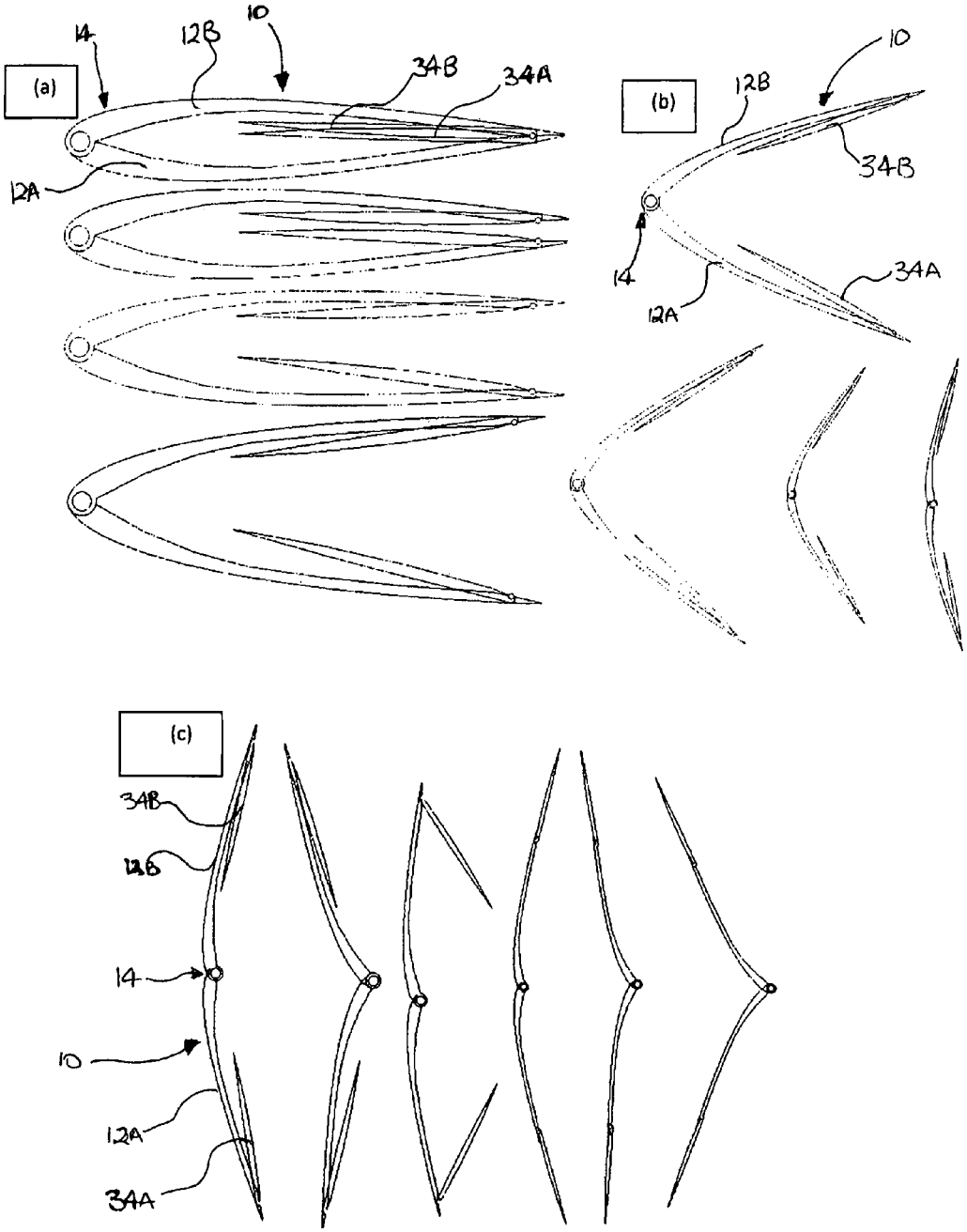

FIGS. 4A to 4C illustrate a further embodiment of a rigid wing 10 according to the present invention. This variation on the rigid wing 10 is essentially the same as the preceding embodiments except for the inclusion of additional panels 34A and 34B. These additional panels 34A/B are pivotally connected to respective of the primary elongate panels 12A/B. The additional or secondary panels 34A/B collapse inwardly of the rigid wing 10 in its closed configuration. In order to avoid repetition and for ease of reference like components of this embodiment have been indicated with the same reference numeral as the preceding embodiments.

The secondary panels 34A/B are of a one-piece rigid material. The secondary panels are each curved so that in the open configuration the rigid wing 10 forms a continuation of the primary panels 12A/B. FIG. 4C illustrates gradual opening and closure of the rigid wing 10 of this further embodiment. These secondary panels are driven by and controlled by a joint mechanism at the base of the wing sail.

Figure 5A:
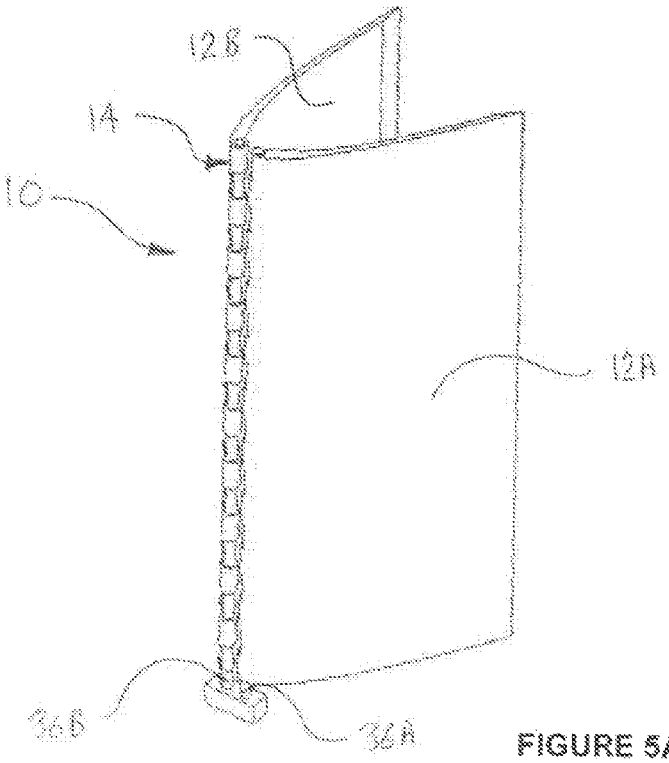
FIGS. 5A and 5B are different views of a rigid wing according to a further embodiment of the invention shown in a partially closed configuration.
Figure 5B:
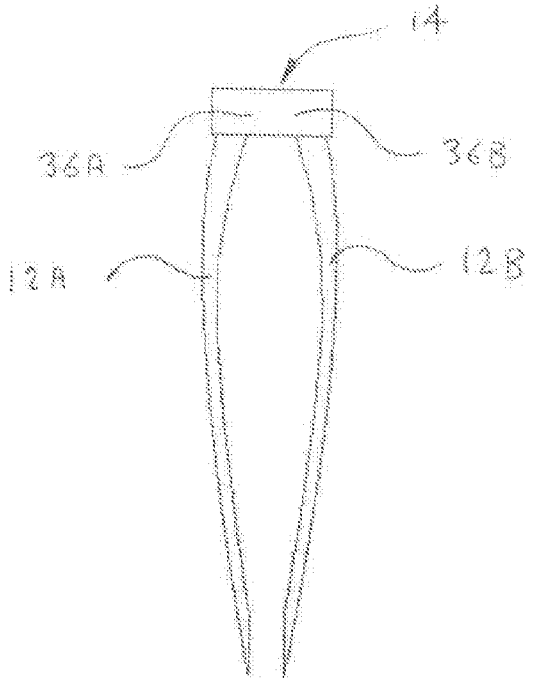

FIGS. 5A and 5B illustrate yet another embodiment of the rigid wing according to the present invention. This variation of the rigid wing includes a pair of shafts 36A and 36B coupled to respective of the elongate panels 12A and 12B. The shafts 36A/B are in this alternative embodiment in the form of a pair of masts about which the respective panels 12A/B pivot for opening and closure. For ease of reference like components of this embodiment have been indicated with the same reference numeral as the preceding embodiments.

Figure 6:
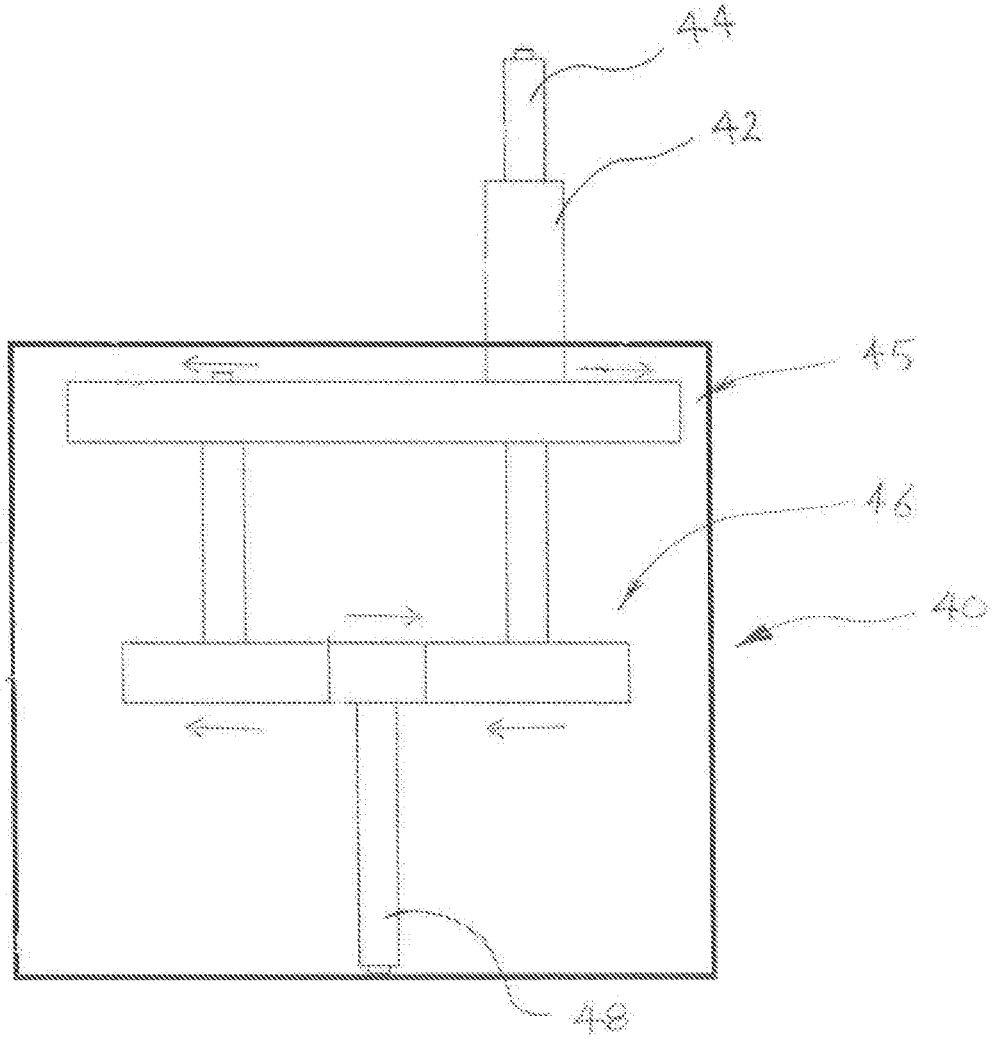
FIG. 6 is schematic illustration of hinge actuating means for pivotal movement of the rigid wing of any one of the previous embodiments, other pair of the rigid panel.

FIG. 6 depicts an embodiment of hinge actuating means for driving pivotal movement of the panels such as 12A and 12B. The hinge actuating means designated as 40 is operatively coupled to the hinge element 14 for pivotal movement of the panels 12A/B relative to one another. For the rigid wing sail 10 of FIGS. 1 to 4, the hinge actuating means 40 includes a pair of coaxial drive shafts 42 and 44 arranged to drive pivotal movement of respective primary panels 12A and 12B. In this embodiment the drive shafts 42 and 44 may be directly fixed to either the panels 12A/B or the respective tubular segments 22*a* and 22*a*'. Alternatively, the drive shafts 42 and 44 may be indirectly coupled to the elongate panels 12A/B, for example via intermediate gears (not shown). In this example the actuating means 40 includes a gear train designated as 45 and 46 driven by an electric motor (not shown) coupled to drive shaft 48.

In the alternative embodiment of FIG. 5 the drive shafts 42 and 44 are axially spaced from one another to align or cooperate independently with the respective shafts or masts 36A and 36B. In either case the hinge actuating means 40 includes the drive motor coupled to both the drive shafts 42 and 44 via an appropriate gear arrangement which provides rotation of the shafts 42 and 44 in opposite directions. Alternatively the hinge actuating means may include a pair of drive motors coupled to respective of the drive shafts 42 and 44.

Figure 7A:
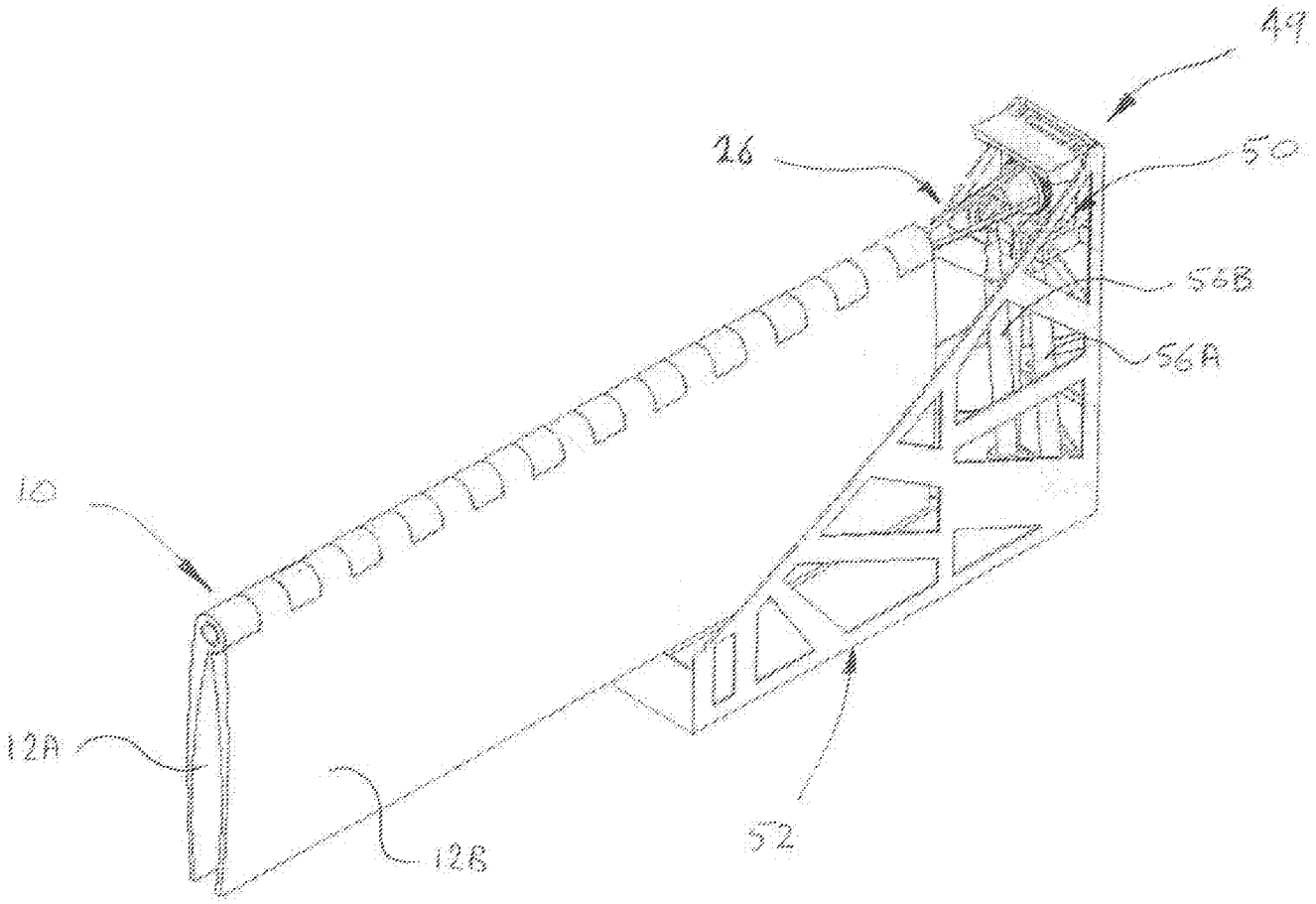
FIGS. 7A to 7C are isometric views of the rigid wing of the preferred embodiment mounted to a joint mechanism for raising and lower of the rigid wing of any one of the previous embodiments and various methods for stowing.
Figure 7B:
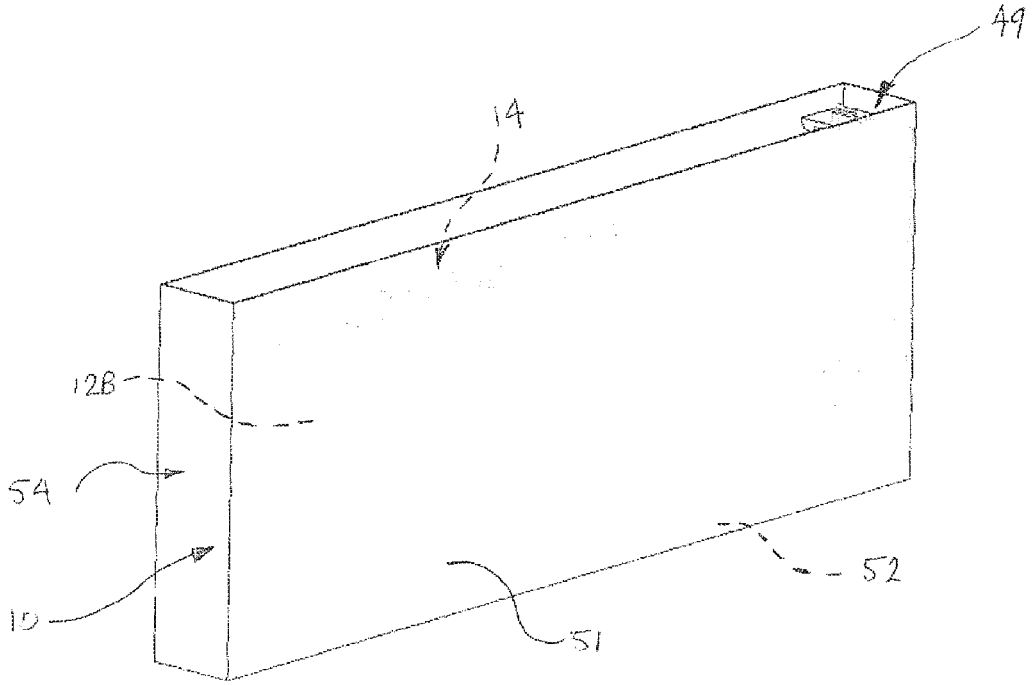
Figure 7C:
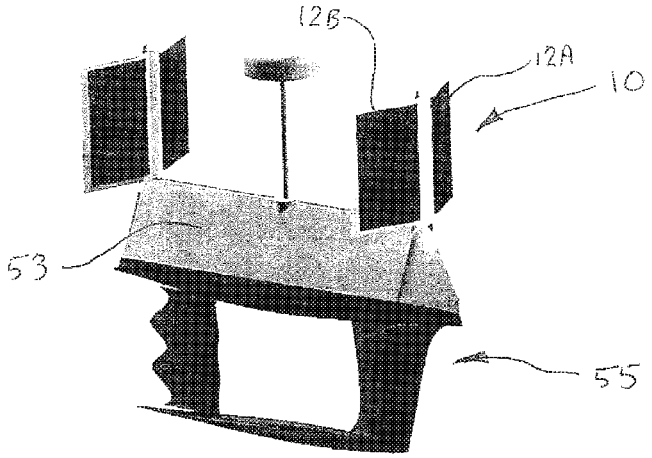

FIGS. 7A to 7C show one example of a joint mechanism 49 for raising and lowering of the rigid wing sail such as 10. When the mast 28 is lowered the rigid panels can be:

a) closed and folded one side or another on a deck (see FIG. 7A);

b) closed and stowed into a superstructure 51 and hull of a vessel (see FIG. 7B);

c) opened and 'wrapped' around a superstructure 53 of a vessel 55 designed to be of a complementary shape (see FIG. 7C);

d) opened and stored horizontally as an 'awning' (not shown).

In this embodiment the rigid wing 10 includes the mast 26 mounted to a tilting platform 50. The tilting platform 50 pivotally connects to a pedestal 52 which is designed to for example mount to the deck of a water-borne vessel (not shown). The rigid wing 10 in its closed configuration may as shown in FIG. 7B also be housed within a cassette or compartment 54 located above or below deck when the rigid wing 10 is lowered.

The tilting platform 50 is in this embodiment tilted via one or more hydraulic cylinders such as 56A and 56B connected at opposing ends to a base of the pedestal 52 and the tilting platform 50. The tilting platform 50 is thus pivoted relative to the pedestal 52 for raising or lower of the rigid wing 10 preferably in its closed configuration. Alternatively the pedestal 52 mounted above deck the rigid wing 10 may be lowered in its open configuration wherein it provides shade.

The rigid wing sail 10 may additionally be clad or partly covered in solar panels (not shown), preferably on the convex surfaces on one or both of the elongate panels such as 12A and 12B. The solar panels may take the form of solar photovoltaic (PV) panels such as those rolled out in strip form across the rigid wing 10. The solar panels may be used to generate electricity which is harnessed to assist in driving or supporting ancillary equipment of the vessel (not shown)

Now that several preferred embodiments of the invention have been described it will be apparent to those skilled in the art that the rigid wing has at least the following advantages:

1. The rigid wing can be reduced in area or effectively reefed by pivotal movement of the panels into the closed configuration;
2. The rigid wing can be reconfigured to effectively capture the wind by shifting the relative disposition of the panels to effectively reshape/alter the camber of the wing;
3. The rigid wing lends itself to mounting arrangement which permit:

i. slewing movement to change the angle of the rigid wing relative to the apparent wind for effective operation; and/or ii. tilting of the rigid wing for raising or lowering, for example to effectively stow on or within the vessel to which it is mounted;

4. The rigid wing in its preferred form includes a pair of elongate panels each of a one-piece construction which lends itself to relatively simple and inexpensive fabrication.

Those skilled in the art will appreciate that the invention described herein is susceptible to variations and modifications other than those specially described. For example, the hinge actuating means may depart from the mechanical arrangement described and, for example, be driven by hydraulics or pneumatics. The elongate panels of the rigid wing need not necessarily be shaped according to the preferred embodiments to provide an aerofoil section and could in their simplest form be limited to planar panels. The materials of construction may also depart from that described provided the rigid wing and panels are fabricated predominantly from a rigid material. The rigid wing is not to be limited to its application on water-borne vessels but may extend to other applications such as airships, spaceships, landships, and iceships.

All such variations and modifications are to be considered within the scope of the present invention the nature of which is to be determined from the foregoing description.

The claims defining the invention are as follows:

1. A rigid wing sail comprising:

a pair of elongate rigid panels each having an adjoining edge opposing a lateral edge, the adjoining edges of the pair of elongate rigid panels together defining an elongate bore;

a hinge element including a mast coupled to the pair of elongate rigid panels at their adjoining edges to permit pivotal movement of said rigid panels relative to one another and about the mast to form either:

i) a closed configuration wherein the lateral edges of said rigid panels are adjacent one another wherein the rigid wing sail is substantially closed; or ii) various open configurations wherein the lateral edges of the elongate rigid panels are separated from one another wherein the rigid wing sail is set at a variable camber to effectively capture wind by shifting the relative disposition of the rigid panels to reshape and alter the camber of the rigid wing sail;

wherein the mast is received within the elongate bore and located at the adjoining edges of the pair of rigid panels in both the closed and the various open configurations.

2. The rigid wing sail as defined in claim 1, wherein the hinge element is in the form of a piano-type hinge which forms the elongate bore.

3. The rigid wing sail as defined in claim 1 wherein the mast is mounted to a joint mechanism which permits tilting of the mast thereby raising and lowering of the mast and the associated rigid wing sail.

4. The rigid wing sail as defined in claim 1 also comprising solar collectors mounted or applied to at least an exposed surface of the pair of elongate panels.

5. The rigid wing sail as defined in claim 1 wherein each of the pair of rigid panels is one continuous piece of rigid material.

6. The rigid wing sail as defined in claim 1 wherein the pair of panels are each curved panels of an asymmetric sectional shape.

7. The rigid wing sail as defined in claim 6 wherein the pair of asymmetric panels have substantially the same profile and sectional shape.

8. The rigid wing sail as defined in claim 7 wherein the rigid wing sail at the variable camber is symmetric either side of the hinge element.

9. The rigid wing sail as defined in claim 1 also comprising a pair of secondary rigid panels being elongate and pivotally coupled to respective of the pair of rigid panels at their lateral edges, the secondary pair of rigid panels arranged to form a continuation of the rigid panels in the various open configurations and to collapse inwardly of the rigid wing sail in its closed configuration.

10. The rigid wing sail as defined in claim 1 further comprising hinge actuator assembly operatively coupled to the hinge element for pivotal movement of said panels relative to one another.

11. The rigid wing sail as defined in claim 10 wherein the hinge actuator assembly includes one or more gears operatively coupled to at least one of the elongate rigid panels and the hinge element.

12. A rigid wing sail as defined in claim 1 further comprising slewing means operatively coupled to the mast to permit slewing of the mast about its longitudinal axis to orient the rigid wing sail at a required angle to the wind.

13. A rigid wing sail as defined in claim 10 wherein the hinge actuator assembly includes slewing means configured to orient the rigid wing sail at a required angle to the wind.

14. A rigid wing sail as defined in claim 1 adapted to fit to a vehicle.

15. A rigid wing sail as defined in claim 14 wherein the vehicle is a water-borne vessel.

16. A rigid sail comprising:

a pair of elongate rigid planar panels each having an adjoining edge opposing a lateral edge, the adjoining edges of the pair of elongate rigid planar panels together defining an elongate bore;

a hinge element including a mast coupled to the pair of elongate rigid planar panels at their adjoining edges to permit pivotal movement of said rigid planar panels relative to one another and about the mast to form either:

i) a closed configuration wherein the lateral edges of said rigid planar panels are adjacent one another wherein the rigid sail is substantially closed; or ii) various open configurations wherein the lateral edges of the elongate rigid planar panels are separated from one another wherein the rigid planar panels are set at a variable angle to each other to shift the relative disposition of the rigid planar panels to reshape the rigid sail;

wherein the mast is received within the elongate bore and located at the adjoining edges of the pair of rigid planar panels in both the closed and the various open configurations.

17. A rigid wing sail comprising:

a pair of elongate rigid panels each having an adjoining edge opposing a lateral edge;

a hinge element including a mast coupled to the pair of elongate rigid panels at their adjoining edges to permit pivotal movement of said rigid panels relative to one another and about the mast to form either:

i) a closed configuration wherein the lateral edges of said rigid panels are adjacent one another wherein the rigid wing sail is substantially closed; or ii) various open configurations wherein the lateral edges of the elongate rigid panels are separated from one another wherein the rigid wing sail is set at a variable camber to effectively capture wind by shifting the relative disposition of the rigid panels to reshape and alter the camber of the rigid wing sail;

wherein the mast is located at the adjoining edges of the pair of rigid panels in both the closed and the various open configurations and wherein the mast is mounted to a joint mechanism which permits tilting of the mast thereby raising and lowering of the mast and the associated rigid wing sail.

18. A rigid wing sail comprising:

a pair of elongate rigid panels each having an adjoining edge opposing a lateral edge;

solar collectors mounted or applied to at least an exposed surface of the pair of elongate rigid panels;

a hinge element including a mast coupled to the pair of elongate rigid panels at their adjoining edges to permit pivotal movement of said rigid panels relative to one another and about the mast to form either:

i) a closed configuration wherein the lateral edges of said rigid panels are adjacent one another wherein the rigid wing sail is substantially closed; or ii) various open configurations wherein the lateral edges of the elongate rigid panels are separated from one another wherein the rigid wing sail is set at a variable camber to effectively capture wind by shifting the relative disposition of the rigid panels to reshape and alter the camber of the rigid wing sail;

wherein the mast is located at the adjoining edges of the pair of rigid panels in both the closed and the various open configurations.

19. A rigid wing sail comprising:

a pair of elongate rigid panels each having an adjoining edge opposing a lateral edge;

a pair of secondary elongate rigid panels that is pivotally coupled to the pair of rigid panels at their lateral edges, the secondary pair of rigid panels being arranged to form a continuation of the rigid panels in the various open configurations and to collapse inwardly of the rigid wing sail in its closed configuration;

a hinge element including a mast coupled to the pair of elongate rigid panels at their adjoining edges to permit pivotal movement of said rigid panels relative to one another and about the mast to form either:

i) a closed configuration wherein the lateral edges of said rigid panels are adjacent one another wherein the rigid wing sail is substantially closed; or ii) various open configurations wherein the lateral edges of the elongate rigid panels are separated from one another wherein the rigid wing sail is set at a variable camber to effectively capture wind by shifting the relative disposition of the rigid panels to reshape and alter the camber of the rigid wing sail;

wherein the mast is located at the adjoining edges of the pair of rigid panels in both the closed and the various open configurations.

20. A rigid wing sail comprising:

a pair of elongate rigid panels each having an adjoining edge opposing a lateral edge;

a hinge element including a mast coupled to the pair of elongate rigid panels at their adjoining edges;

a hinge actuator assembly comprising one or more gears operatively coupled to at least one of the pair of elongate rigid panels and the hinge element, the hinge actuator assembly being operatively coupled to the hinge element for pivotal movement of said panels relative to one another and about the mast to form either:

i) a closed configuration wherein the lateral edges of said rigid panels are adjacent one another wherein the rigid wing sail is substantially closed; or ii) various open configurations wherein the lateral edges of the elongate rigid panels are separated from one another wherein the rigid wing sail is set at a variable camber to effectively capture wind by shifting the relative disposition of the rigid panels to reshape and alter the camber of the rigid wing sail;

wherein the mast is located at the adjoining edges of the pair of rigid panels in both the closed and the various open configurations.

* * * * *